US009068746B2

(12) United States Patent
Kurata et al.

(10) Patent No.: US 9,068,746 B2
(45) Date of Patent: Jun. 30, 2015

(54) BIOMASS-MIXED-FIRING PULVERIZED COAL FIRED BOILER AND OPERATION METHOD OF THE BOILER

(75) Inventors: Chikatoshi Kurata, Chiba (JP); Kazuhito Yoshikawa, Sakura (JP); Kazuyoshi Kaizuka, Tokyo (JP); Koji Taniguchi, Sakura (JP); Takaharu Asakawa, Zushi (JP); Noriaki Ishikawa, Tokyo (JP)

(73) Assignees: KAWASAKI JUKOGYO KABUSHIKI KAISHA, Kobe (JP); MAGALDI INDUSTRIE S.R.L., Salerno (IT)

( * ) Notice: Subject to any disclaimer, the term of this patent is extended or adjusted under 35 U.S.C. 154(b) by 697 days.

(21) Appl. No.: 12/988,804

(22) PCT Filed: May 13, 2009

(86) PCT No.: PCT/JP2009/058887

§ 371 (c)(1),
(2), (4) Date: Dec. 28, 2010

(87) PCT Pub. No.: WO2009/139404

PCT Pub. Date: Nov. 19, 2009

(65) Prior Publication Data

US 2011/0107948 A1 May 12, 2011

(30) Foreign Application Priority Data

May 16, 2008 (JP) ..... 2008-129783

(51) Int. Cl.
*F23C 1/00* (2006.01)
*F23J 1/06* (2006.01)

(Continued)

(52) U.S. Cl.
CPC ..... *F23J 1/06* (2013.01); *F23J 2700/001* (2013.01); *F23J 2700/002* (2013.01);

(Continued)

(58) Field of Classification Search
CPC ..... F23G 2209/30; F23J 1/02; F23J 1/00; F23J 2900/01002; F23J 1/06; F23J 2900/01003; F23J 2700/001; F23J 2700/003; F27D 15/0213; F27D 15/0206; F27D 15/0266
USPC ..... 110/262, 165 R, 347
See application file for complete search history.

(56) References Cited

U.S. PATENT DOCUMENTS 4,481,890 A * 11/1984 Lewis ..... 110/225
4,887,539 A 12/1989 Magaldi (Continued)

FOREIGN PATENT DOCUMENTS

JP 63-034408 2/1988
JP 63034408 2/1988

(Continued)

OTHER PUBLICATIONS

PCT International Search Report for PCT/JP2009/058887 filed on May 13, 2009 in the name of Kawasaki Plan Systems Kabushiki Kaisha.

(Continued)

*Primary Examiner* — David J Laux
(74) *Attorney, Agent, or Firm* — Steinfl & Bruno LLP

(57) ABSTRACT

A biomass-mixed-firing pulverized coal fired boiler includes: a furnace for burning biomass fuel together with pulverized coal in a mixed state; a pulverized coal burner for supplying the pulverized coal into the furnace; a biomass burner for supplying the biomass fuel into the furnace; a biomass mill for milling the biomass fuel to be supplied to the biomass burner; a dry clinker processing unit provided below the furnace and including a clinker conveyor for carrying ashes discharged from the furnace at a furnace bottom; and a combustion-air supply unit for supplying combustion air toward the ashes discharged at the furnace bottom on the clinker conveyor, thereby to burn an unburned component of the biomass fuel contained in the ashes discharged at the furnace bottom on the clinker conveyor.

11 Claims, 9 Drawing Sheets

(51) Int. Cl.

| | |
|---|---|
| ***F23K 1/00*** | (2006.01) |
| ***F27D 15/02*** | (2006.01) |
| ***F23C 5/08*** | (2006.01) |
| ***F23J 1/02*** | (2006.01) |
| *F22B 21/00* | (2006.01) |

(52) U.S. Cl.

CPC ..... *F27D 15/0266* (2013.01); *F22B 21/00* (2013.01); *F23C 1/00* (2013.01); *F23C 5/08* (2013.01); *F23C 2900/01001* (2013.01); *F23J 1/02* (2013.01); *F23K 2201/1003* (2013.01); *F23G 2209/30* (2013.01)

(56) References Cited

U.S. PATENT DOCUMENTS

| | | | | |
|---|---|---|---|---|
| 5,255,615 | A * | 10/1993 | Magaldi | 110/234 |
| 5,609,113 | A * | 3/1997 | Galipeault et al. | 110/347 |
| 5,775,237 | A * | 7/1998 | Reilly et al. | 110/234 |
| 6,938,560 | B2 * | 9/2005 | Okazaki et al. | 110/204 |
| 6,973,883 | B1 * | 12/2005 | Annamalai et al. | 110/345 |
| 7,311,049 | B2 * | 12/2007 | Magaldi | 110/171 |
| 8,015,932 | B2 * | 9/2011 | Eiteneer et al. | 110/262 |

FOREIGN PATENT DOCUMENTS

| | | |
|---|---|---|
| JP | 7056375 | 6/1995 |
| JP | 2004-347271 | 12/2004 |
| JP | 2005-241108 | 9/2005 |
| JP | 2005-291531 | 10/2005 |
| JP | 2005-291539 | 10/2005 |
| JP | 2007-101135 | 4/2007 |
| JP | 2008-082651 | 4/2008 |

OTHER PUBLICATIONS

Written Opinion for PCT/JP2009/058887 filed on May 13, 2009 in the name of Kawasaki Plan Systems Kabushiki Kaisha. (Japanese and English translation).

* cited by examiner

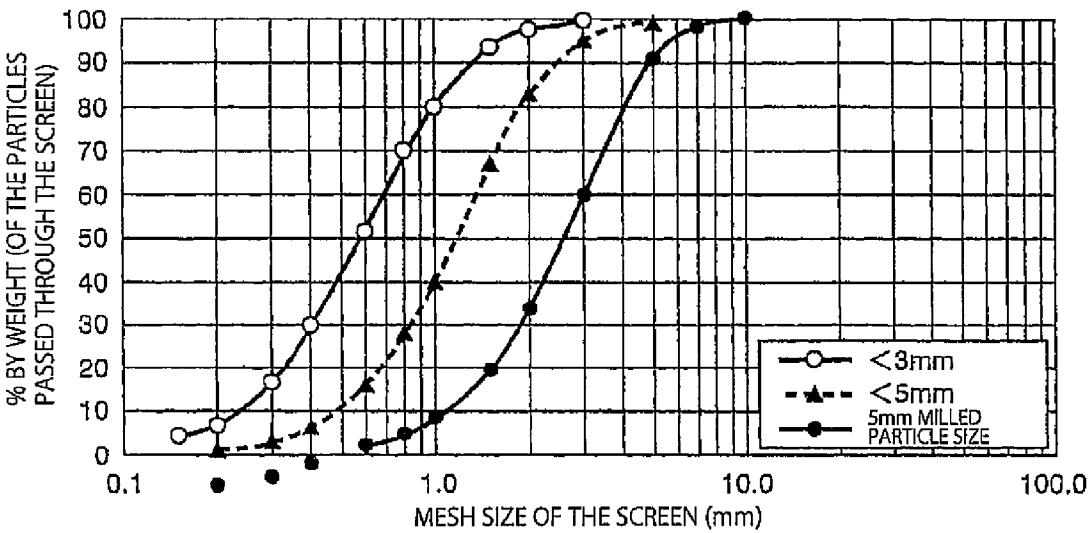

EXAMPLE OF THE PARTICLE-SIZE DISTRIBUTION OF THE MILLED WOODY BIOMASS FUEL

IN THIS GRAPH, THE PARTICLE SIZE LESS THAN 5mm (<5mm) AND 5mm MILLED PARTICLE SIZE ARE RESPECTIVELY ESTIMATED, BASED ON THE PARTICLE-SIZE DISTRIBUTION OF THE BIOMASS PARTICLES OF THE PARTICLE SIZE LESS THAN 3mm (<3mm) (PREPARED FROM CONSTRUCTION AND DEMOLITION WASTE OR SCRAP WOOD) THAT HAVE BEEN ACTUALLY MILLED AND SUBJECTED TO A BURNING TEST.

<3mm: 99% BY WEIGHT OF THE PARTICLES HAVE THE PARTICLE SIZE LESS THAN 3mm;
AVERAGE MILLED PARTICLE SIZE d50 = 0.59mm
<5mm: 99% BY WEIGHT OF THE PARTICLES HAVE THE PARTICLE SIZE LESS THAN 5mm;
AVERAGE MILLED PARTICLE SIZE d50 = 1.15mm
5mm MILLED PARTICLE SIZE: 90% BY WEIGHT OF THE PARTICLES HAVE THE PARTICLE SIZE LESS THAN 5mm;
AVERAGE MILLED PARTICLE SIZE d50 = 2.5mm

FIG. 8

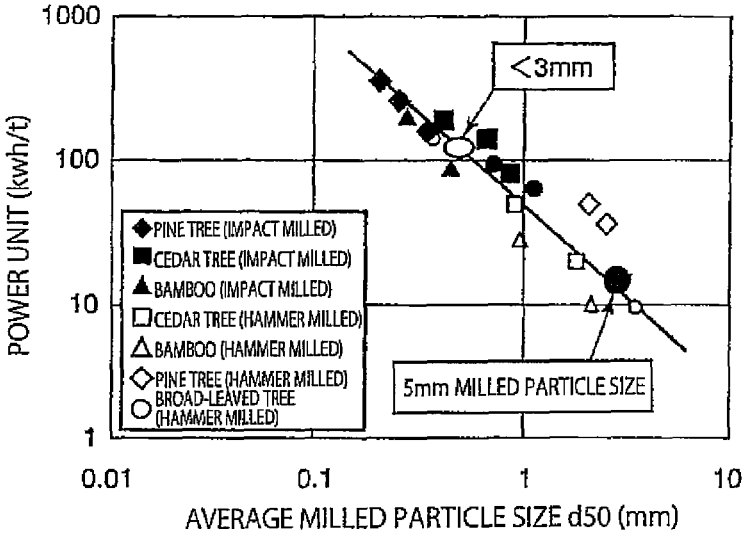

POWER UNIT FOR MILLING THE BIOMASS FUEL
DATA ON THE POWER UNIT FOR MILLING THE BIOMASS FUEL, ACTUALLY MEASURED AND DESCRIBED IN A REPORT OPENED TO THE PUBLIC BY CONTRACT RESEARCH OF NEDO THE COARSE PARTICLES HAVING SUCH A LARGE AVERAGE MILLED PARTICLE SIZE (d50) THAT CAN ALLOW THE POWER REQUIRED FOR MILLING SUCH PARTICLES TO BE SUBSTANTIALLY REDUCED CAN BE MILLED BY ONLY HAMMER MILLING.

THE POWER UNIT ESTIMATED FOR THE 5mm MILLED PARTICLE SIZE IS LOWER BY ABOUT ONE DIGIT THAN THE POWER UNIT MEASURED FOR THE MILLED PARTICLE SIZE LESS THAN 3mm WHEN 50%-BY-WEIGHT PARTICLE SIZE IS PLOTTED IN THE DATA.

FIG. 9

BIOMASS-MIXED-FIRING PULVERIZED COAL FIRED BOILER AND OPERATION METHOD OF THE BOILER

CROSS REFERENCE TO RELATED APPLICATIONS

The present application is the US national stage of International Application PCT/JP2009/058887 filed on May 13, 2009 which, in turn, claims priority to Japanese Patent Application 2008-129783 filed on May 16, 2008.

TECHNICAL FIELD

The present invention relates to a boiler adapted for burning biomass fuel (mainly containing woody fuel) together with pulverized coal in a mixed state (i.e., this invention relates to a biomass-mixed-firing pulverized coal fired boiler).

As used herein, the term "milled particle size" of the biomass fuel means "the size of a mesh (or mesh size)" used for screening the biomass fuel once milled into particles. For instance, a "5 mm milled particle size (or milled particle size equal to 5 mm)" is used herein for expressing such a particle size of the biomass fuel that 90% by weight of the particles of the biomass fuel can be passed through a 5 mm mesh. Further, "the milled particle size equal to or greater than 5 mm" means that 90% by weight or less of the particles of the biomass fuel can be passed through the 5 mm mesh, while "the milled particle size equal to or less than 5 mm" means that 90% by weight or more of the particles of the biomass fuel can be passed through the 5 mm mesh.

Further, as used herein, a "5 mm particle size" means "a limit of biomass particle size that can be subjected to suspension firing." The limit of biomass particle size can vary with the kind, shape, water content and the like, of the biomass fuel or material. In general, however, for wood-based biomass material, approximately 3 to 5 mm particle size can be considered as the limit of biomass particle size.

BACKGROUND ART

In recent years, for substantially reducing the consumption of fossil fuel, it has been demanded and attempted to burn the biomass fuel together with the fossil fuel, such as coal or the like, in an adequately mixed state. To this end, one approach for burning the biomass fuel (e.g., the woody biomass fuel), together with the coal in the mixed state, by using a pulverized coal fired boiler has been studied. As a result, one method has been established and employed, in which a small amount of the biomass fuel is once supplied into a coal bunker and milled therein together with the coal into a powdered material, and the so-obtained powdered material is then supplied into a furnace by air and burned in the furnace.

However, in such a method that the biomass fuel is once milled together with the coal by using a coal mill and then the so-obtained powdered material is burned in the mixed state, the efficiency of milling the coal tends to be lowered, as the ratio of the biomass fuel in the powdered material is raised. Therefore, under the present conditions, the ratio of the biomass fuel to be burned together with the pulverized coal in the mixed state is limited within a range of from approximately 2 to 3% by weight.

In order to raise such a limited ratio of the biomass fuel to be burned together with the pulverized coal in the mixed state, another approach has been proposed, in which the biomass fuel is milled by an exclusive biomass mill, and then the so-milled biomass fuel is supplied to the furnace by using a separate burner different from the burner provided for the pulverized coal, and finally burned in the furnace together with the pulverized coal in the mixed state. It is true that this method can securely avoid the lowering of the efficiency of milling the coal as described above. Thus, the ratio of the biomass fuel in the milled or powdered material to be burned in the mixed state can be considerably raised, without unduly lowering the efficiency of milling the coal. However, if such increased biomass fuel cannot be adequately subjected to the suspension firing in the furnace, the efficiency of burning the fuel will be in turn degraded. Namely, in order to achieve adequate suspension firing of the biomass fuel in the furnace, the particle size of such biomass fuel should be controlled within the range of the aforementioned limit of particle size (e.g., for the wood-based or woody biomass fuel, within the range of from approximately 3 to 5 mm). However, in the case in which a considerably great amount of the biomass fuel is milled into the particles of such a relatively small particle size, i.e., within the range of from 3 to 5 mm, very great milling power should be required, leading to so great energy loss, thus rather getting out of the primary purpose in utilizing the biomass fuel.

FIG. 8 is a graph showing distribution of the particle size of the woody biomass fuel once milled by the exclusive biomass mill. In this drawing, the milled particle size less than 5 mm (<5 mm) and 5 mm milled particle size are estimated, respectively based on the particle-size distribution actually measured for the milled particle size less than 3 mm (<3 mm) of the biomass fuel. FIG. 9 is a graph showing a relationship between the average milled particle size d50 (50%-by-weight particle size) and the power unit (i.e., the unit of power required for milling the biomass fuel) (kwh/t), as described in a report opened to the public (by NEDO). As is seen from FIG. 9, the power unit plotted corresponding to the 5 mm milled particle size is lower, by about one unit or digit, than the power unit plotted corresponding to the milled particle size less than 3 mm.

Therefore, if the allowable range of the particle size of the biomass fuel milled by the exclusive biomass mill may be set equal to or greater than 5 mm, the power required for milling such biomass fuel can be significantly reduced.

For instance, in order to reduce the power required for milling the biomass fuel, JP2005-291531A (Patent Document 1) describes one technique for milling the biomass fuel into the milled particle size equal to or less than 5 mm by using the exclusive biomass mill, and then burning such milled biomass fuel together with the pulverized coal in the mixed state (hereinafter, this technique will be referred to as "the first related art." Specifically, this technique is configured as shown in FIG. 4, wherein pulverized coal burners 4 and biomass-burners 5 are respectively provided in the same levels on a plurality of stages. Further, as shown in FIG. 4, the coal supplied from the coal bunker 11 is milled by the coal mill 6, and then fed to the furnace 1 by each pulverized coal burner 4. Meanwhile, the biomass fuel 16 is once supplied to a biomass bunker 12, and milled by the biomass mill 13, and then fed to the furnace 1 by each biomass burner 5. Thereafter, the pulverized coal and milled biomass fuel are burned together, with combustion air supplied from a wind box 3, then blown upward, and further burned in an upper region of the furnace with the combustion air supplied from an air injection port 2. In this case, the biomass fuel of a relatively small particle size will be burned while being suspended in the furnace, and then flowed out from the furnace together with exhaust gas. Meanwhile, the biomass fuel of a relatively large particle size will fall down toward bottom of the furnace (or furnace bottom) against the flow of the combustion gas while being burned.

Ideally, even in the case in which the particle size of the biomass fuel is relatively large, such biomass fuel can be completely burned and changed into ashes before the fuel reaches the furnace bottom. Actually, however, the particle size of the biomass fuel that can allow the fuel to be completely burned and changed into the ashes is limited within the range of from 3 to 5 mm. Meanwhile, in the case of burning the particles of the biomass fuel having the particle size exceeding this range, some volatile and/or moisture components of such large-sized particles can be released therefrom, as well as some carbon-based components thereof can be partly burned. However, such large-sized particles will remain unburned at a considerably high ratio or proportion, and thus fall down onto a clinker processing unit 17 provided below the furnace bottom.

Generally, in the case of milling the biomass fuel into the particles having the milled particle size equal to or less than 5 mm (i.e., 90% by weight or more of the particles having the particle size less than 5 mm, and the remaining 10% of the particles having the particle size equal to or greater than 5 mm), the power required for milling the biomass fuel tends to be increased, exponentially, with decrease of the milled particle size of the biomass fuel. Therefore, if the allowable range of the particle size of the biomass fuel milled by the exclusive biomass mill may be set greater than 5 mm (i.e., the maximum particle size is equal to or greater than 5 mm and 90% by weight of less of the particles have the particles size less than 5 mm), the power required for milling such biomass fuel can be significantly reduced. The above first related art is based on such experimental results and findings as described above, thus attempting to utilize the biomass fuel having the 5 mm milled particle size. However, as is also described above, such medium particles of the biomass fuel (i.e., the particles having the 5 mm particle size) tends to fall down toward the furnace bottom and reach the clinker processing unit 17, while remaining unburned (i.e., unchanged into the ashes). In addition, such medium particles will be cooled on the clinker processing unit 17, while still remaining unburned, and then changed into a carbonized material. Thus, for solving this problem, the first related art is also intended to collect or recover such a carbonized material by a wet separation process (such as by separating and floating the carbonized material with water from the clinker processing unit 17). Namely, such a carbonized material can be collected or recovered to be supplied again to the coal bunker 11 and milled by the coal mill 6, and then supplied and burned in the furnace. According to this method, even in the case of using the biomass fuel milled into the 5 mm particle size, such biomass fuel can be well burned together with the pulverized coal in the mixed state without degrading the efficiency of milling the coal by using the coal mill.

Further, in the above first related art, as shown in FIG. 4, a wet separation unit 14 is provided to the wet clinker processing unit, wherein this wet separation unit 14 is connected with a carbonized-material bunker 15 by means of a carbonized-material transport unit 18 which is provided between the wet separation unit 14 and the carbonized-material bunker 15.

Namely, according to this first related art, the unburned biomass fuel (or carbonized material) having fallen down on the clinker processing unit 17 can be subjected to a wet process, and then separated and collected from the clinker processing unit 17 by the wet separation unit 14. Thereafter, the so-collected carbonized material can be transported to the carbonized-material bunker 15 by the carbonized-material transport unit 18, and then supplied to the coal bunker 11 from the carbonized-material bunker 15. Thereafter, the carbonized material supplied to the coal bunker 11 can be milled together with the pulverized coal into the powdered material by the coal mill 6, and then burned by each pulverized coal burner 4.

Basically, the first related art features cooling the carbonized unburned biomass fuel by the wet clinker processing unit and then collecting such cooled unburned biomass fuel (or carbonized material) by the wet separation unit 14. However, this related art also implies use of a dry clinker processing unit.

In addition, according to the above first related art, the biomass fuel (or carbonized material) that has been cooled and then collected via the wet clinker processing unit is well carbonized and includes the medium particles b as shown in FIG. 5. Therefore, such biomass fuel or carbonized material is likely to be milled, showing very low resistance against the milling performed by the coal mill 6.

However, if the biomass fuel contains a relatively large amount of coarse particles (i.e., coarse particles B also shown in FIG. 5) having the particle size greater than 5 mm, a correspondingly large amount of woody cores may tend to remain in the unburned or carbonized material when the material is recovered from the clinker processing unit 17. Therefore, if such carbonized material containing such a great amount of the woody cores is supplied to the coal mill, the efficiency of milling the coal may tend to be rather degraded.

From such findings, in the above first related art, the particle size of the biomass fuel to be burned together with the pulverized coal in the mixed state is limited within the range that can allow the particles of the biomass fuel to adequately fall down toward the furnace bottom as well as allow such particles to be completely carbonized.

Namely, if the particle size of the biomass fuel is unduly great (e.g., greater than 7 mm), such coarse particles will fall down in a considerably great amount onto the clinker processing unit 17 with an unduly large amount of the woody cores remaining therein. Accordingly, the milled particle size of the biomass fuel should be controlled not to be so great. In addition, as the particle size is considerably increased, the speed of the particles falling downward in the furnace will be raised so much, thus rather reducing a period of time during which such particles can be subjected to the suspension firing in the furnace, leading to production of an unduly large amount of the unburned material.

It should be noted that the above Patent Document 1 is silent about any specific structure of the dry clinker processing unit. In other words, this reference suggests or teaches nothing about the structure of such a dry clinker processing unit, in particular, about the mechanism or method of cooling the unburned biomass fuel or carbonized material. Meanwhile, the dry clinker processing unit itself has publicly known, so far, as a "clinker processing unit", and one example of such a dry clinker processing unit is described in JP7-56375B (Patent Document 4). FIG. 7 schematically shows such a publicly known clinker processing unit. Namely, as shown in FIG. 7, this dry clinker processing unit includes a conveyor belt 23 provided below the furnace bottom and made of a highly heat-resistant metal. With this configuration, the ashes can fall down onto the conveyor belt 23, while being guided through a transition hopper 20 provided between the furnace 1 and the conveyor belt 23. In this case, the conveyor belt 23 is driven by one or more drive wheels or rollers 24.

Further, this dry clinker processing unit includes a casing 22 having a hermetically sealed structure. Additionally, several of cooling-air intake holes 31 are provided on one side of the conveyor belt 23, such that cooling air can be supplied into the clinker processing unit.

With the provision of this dry clinker processing unit, the ashes having fallen on the bottom of the furnace 1 can be received or caught by the conveyor belt 23, and transferred slowly (e.g., at 5 mm per second) toward a clinker collecting device 41. During this transfer operation, the ashes can be slowly cooled by the air for about one hour (i.e., the time required for each transfer operation of the conveyor belt 23). Then, the so-transferred-and-cooled ashes are finally discharged from the clinker processing unit and collected by the clinker collecting device 41. Therefore, according to this dry clinker processing unit 21, the cooling air is supplied into the body or casing of the clinker processing unit 21, such that the ashes having fallen down on the conveyor belt 23 can be gradually cooled during the transfer thereof through the body of the clinker processing unit 21. Thereafter, the so-cooled ashes can be discharged to the outside from the clinker processing unit 21. Meanwhile, the cooling air supplied into the body of the clinker processing unit 21 is heated by the burned ashes up to a high temperature around the furnace bottom, and then drawn upward into the furnace 1 to be confluent with the combustion gas present in the furnace 1.

However, in the case in which this dry clinker processing unit is applied to the pulverized coal fired boiler, the amount of the cooling air supplied into the dry clinker processing unit should be limited to approximately 2% relative to the amount of the combustion air directly supplied to the furnace. Further, in this case, the ashes can be cooled to approximately 100° C., at or around the furnace bottom, for the period of time (i.e., about one hour) during which the ashes are transferred through the body (see FIG. 7) of the clinker processing unit to the discharge point thereof.

By the way, another related art, which includes the biomass burners respectively arranged above the pulverized coal burners, in order to suspend the biomass particles on an ascending flow or current of the air and other gases and thus lengthen the time for which such biomass fuel can be burned in the furnace, has also been known (see FIG. 6). Namely, in this boiler system, the biomass burners 5 are respectively located in an upper portion of the furnace 1, while the pulverized coal burners are respectively located in a lower portion of the furnace 1. In other words, a combustion region F1 for the pulverized coal is provided in the lower portion of the furnace 1, while another combustion region F2 for the biomass fuel is provided in the upper portion of the furnace 1. With this configuration, the speed of the biomass fuel falling downward in the furnace 1 can be successfully lowered, by utilizing the ascending flow of the air and other gases created by the flame of the respective pulverized coal burners 4, thereby lengthening the period of time during which the biomass fuel can be suspended in the furnace 1. This related art is disclosed in both of JP2007-101135A (Patent Document 2) and JP2005-241108A (Patent Document 3), and will be referred to as "the second related art." In fact, with the configuration according to the second related art including the biomass burners respectively located above the pulverized coal burners 4, the period of time during which the biomass fuel can be burned in the upper combustion region in the furnace 1 can be somewhat lengthened, as compared with the first related art. Therefore, this second related art can allow the biomass fuel having the relatively large milled particle size to be used for the burning process in the boiler. However, with the increase of the milled particle size of the biomass fuel, the ratio or proportion of the coarse particles B having the particle size equal to or greater than 5 mm is raised. Thus, even if the period of time during which the biomass material can be burned in the furnace can be lengthened to some extent by arranging the respective biomass burners 5 above the respective pulverized coal burners 4, the problem that the woody cores tend to remain unburned in a greater amount cannot be solved.

In addition, for recovering the carbonized material of the biomass fuel and then supplying the so-recovered material to the coal bunker, the above first related art (Patent Document 1) related to the mixed-fuel firing boiler further requires the wet separation unit, transport unit, carbonized-material bunker, carbonized-material mill and the like to be respectively provided thereto. Therefore, for an existing or current coal fired boiler, considerably large-scale equipment should be added thereto in order to adequately burn the biomass fuel together with the pulverized coal in the mixed state, thus unduly increasing the cost for the equipment.

Therefore, in order to significantly raise the ratio or proportion of the biomass fuel in the mixed fuel or material to be burned in the furnace as well as to improve the efficiency and effect of utilizing such biomass fuel, with the cost required for the operation and equipment of the boiler being substantially reduced, it is necessary to provide a significantly improved mechanism or method of burning the biomass fuel together with the pulverized coal in the mixed state in the pulverized coal fired boiler with highly enhanced combustion efficiency and effect. Namely, even in the case in which the biomass fuel of the relatively large particle size is supplied to the furnace of the boiler, this mechanism or method needs to significantly raise the ratio or proportion of such biomass fuel to be burned together with the pulverized coal in the mixed state, as well as can burn such biomass fuel completely into the ashes. Besides, this mechanism or method needs to be achieved and implemented without requiring unduly large-scale additional equipment.

DISCLOSURE OF THE INVENTION

The present invention was made in light of the above problems of the above related arts. Therefore, it is an object of this invention to significantly raise the ratio of the biomass fuel to be burned together with the pulverized coal in the mixed state, while allowing the biomass fuel having the relatively large particle size (in particular, the biomass fuel having the milled particle size equal to or greater than 5 mm) to be used, without requiring unduly large-scale equipment to be added to the basic construction of the conventional biomass-mixed-firing pulverized coal fired boiler.

In order to attain the above challenge, the biomass-mixed-firing pulverized coal fired boiler of this invention includes: a furnace configured to burn a biomass fuel together with a pulverized coal in a mixed state; a pulverized coal burner configured to supply the pulverized coal into the furnace; a biomass burner configured to supply the biomass fuel into the furnace; a biomass mill configured to mill the biomass fuel to be supplied to the biomass burner; a dry clinker processing unit provided below the furnace, the dry clinker processing unit including a clinker conveyor configured to carry ashes discharged from the furnace at a furnace bottom; and a combustion-air supply unit configured to supply a combustion air toward the ashes on the clinker conveyor so as to burn an unburned component of the biomass fuel contained in the ashes discharged at the furnace bottom on the clinker conveyor.

Preferably, the biomass mill is configured to mill the biomass fuel into particles having a milled particle size equal to or greater than 5 mm.

Preferably, the combustion-air supply unit is configured to supply the combustion air toward the ashes discharged at the furnace bottom so that the unburned component of the biomass fuel can be completely burned on the clinker conveyor.

Preferably, the boiler further includes a combustion-air controller configured to optimize an efficiency of combustion in an entire boiler by controlling both of a flow rate of a combustion air supplied toward an interior of the furnace and a flow rate of the combustion air supplied from the combustion-air supply unit toward the ashes discharged at the furnace bottom on the clinker conveyor.

Preferably, the biomass burner is located above the pulverized coal burner.

Preferably, the boiler further includes a cooling-air supply unit configured to supply a cooling air to the dry clinker processing unit.

Preferably, the boiler further includes a coal mill configured to mill a coal so as to produce the pulverized coal to be supplied to the pulverized coal burner.

Preferably, the biomass mill is exclusively used for milling the biomass fuel, and the coal mill is exclusively used for milling the coal.

Further, in order to achieve the above challenge, the method of operating a biomass-mixed-firing pulverized coal fired boiler of this invention, includes the steps of: milling a biomass fuel by using a biomass mill; supplying a milled biomass fuel to a furnace by using a biomass burner; supplying a pulverized coal to the furnace by using a pulverized coal burner; burning an unburned component of the biomass fuel contained in ashes discharged at a furnace bottom on a conveyor belt of a dry clinker processing unit, which is provided below the furnace, by supplying a combustion air toward the ashes on the clinker conveyor.

Preferably, the biomass fuel is milled by using the biomass mill into particles having a milled particle size equal to or greater than 5 mm.

Preferably, the combustion air is supplied toward the ashes discharged at the furnace bottom so that the unburned component of the biomass fuel can be completely burned on the clinker conveyor.

Preferably, an efficiency of combustion in an entire boiler is optimized by controlling both of a flow rate of a combustion air supplied toward an interior of the furnace and a flow rate of the combustion air supplied toward the ashes discharged at the furnace bottom on the clinker conveyor.

Preferably, the biomass fuel is supplied to the furnace from the biomass burner which is located above the pulverized coal burner.

Preferably, the method further includes a step of supplying a cooling air to the dry clinker processing unit.

Preferably, the method further includes a step of milling a coal by using a coal mill so as to produce the pulverized coal to be supplied to the pulverized coal burner.

Preferably, the biomass mill is exclusively used for milling the biomass fuel, and the coal mill is exclusively used for milling the coal.

Another object of this invention is to provide a further improved mechanism or method of burning the biomass fuel, with the significantly raised ratio of the biomass fuel to be burned together with the pulverized coal in the mixed state, while allowing the coarse particles of the biomass fuel to be completely burned into the ashes, without requiring any addition of special equipment, for the biomass-mixed-firing pulverized coal fired boiler including both of the exclusive coal mill and exclusive biomass mill and configured to burn the biomass fuel milled by the exclusive biomass mill together with the pulverized coal in the mixed state.

This challenge can be achieved under the following conditions (A) through (D), with the use of the biomass-mixed-firing pulverized coal fired boiler which includes both of the exclusive coal mill and exclusive biomass mill and is configured to burn the biomass fuel milled by the exclusive biomass mill and then supplied to the furnace together with the pulverized coal in the mixed state.

(A) The biomass fuel used for the burning or combustion is milled into the particles having the milled particle size equal to or greater than 5 mm.

(B) The dry clinker processing unit is located below the transition hopper of the boiler.

(C) The dry clinker processing unit includes the combustion-air supply unit, such that the unburned component of the biomass fuel having fallen down on the dry clinker processing unit can be completely burned on the conveyor belt.

(D) The flow rate of the air supplied to the dry clinker processing unit by the combustion-air supply unit and the like and the flow rate of the combustion air supplied to the furnace are controlled, respectively, such that the biomass fuel can be burned, with the optimum efficiency, together with the pulverized coal in the mixed state.

It is noted that the phrase in the above condition (C), "the unburned component of the biomass fuel having fallen down on the dry clinker processing unit can be completely burned," means that the unburned component of the biomass fuel having fallen down on the dry clinker processing unit can be burned substantially completely. Namely, even if only a slight amount of the unburned component remains in the boiler, the main purpose to effectively utilize the heat of combustion that can be obtained by burning such an unburned component in the dry clinker processing unit can be well achieved, along with the burning of the biomass fuel together with the pulverized coal in the mixed state, without causing substantially no negative impact on the operation, while only a quite small amount of usable or unused biomass fuel will be thrown away.

Under the above condition (D), the combustion air is supplied to the dry clinker processing unit, in such an amount that is much greater than the amount of the cooling air required for cooling the clinker processing unit. Thus, such excessive combustion air can be drawn into the furnace from the bottom end of the furnace and further used for the burning or combustion in the furnace. Therefore, in view of the effect of the air excessively supplied to the dry clinker processing unit and then further used for the burning or combustion in the furnace, it is necessary to adequately control the air supply for the entire boiler by appropriately reducing the amount or flow rate of the combustion air directly drawn into the furnace from the wind box.

However, in the case in which the amount or flow rate of the air supplied to the dry clinker processing unit is substantially small, the performance of the boiler will be little affected, even if such a small amount of the air is neglected while controlling of the amount or flow rate of the air directly drawn into the furnace from the wind box. Therefore, in such a case, the condition (D) may be omitted.

(Operations)

First, the biomass fuel is milled into the milled particle size equal to or greater than 5 mm by the exclusive biomass mill, and then the so-milled biomass particles are burned together, with the pulverized coal in the mixed state. At this time, the biomass fuel is blown upward by the combustion gas produced by the pulverized coal burner, and thus will be generally subjected to the suspension firing. However, the coarse biomass particles are flowed downward in the furnace, and finally fall down onto the dry clinker processing unit located below the transition hopper. More specifically, the fine particles of the particle size equal to or less than 3 mm are completely burned out in the furnace, the medium particles of the particles size approximately equal to 5 mm fall down onto the dry clinker processing unit in a substantially carbonized condition, and the coarse particles B fall down onto the conveyor belt with the woody cores still remaining therein.

Since an excessive amount of the combustion air is supplied to the dry clinker processing unit by the combustion-air supply unit, the concentration of oxygen in a region just below the transition hopper is sufficiently high. Meanwhile, the surface temperature of the ashes, just after falling down on the conveyor belt, is considerably high. In addition, the coarse biomass fuel also falls down onto the conveyor belt of the dry clinker processing unit, while being burned. Therefore, the surface temperature of the conveyor belt receiving such ashes and coarse particles thereon can be kept at a quite high temperature.

Accordingly, even after the unburned component of the biomass fuel has fallen down on the conveyor belt, such an unburned component can be continuously burned, and will be burned out into the ashes in several minutes.

The transfer velocity of the conveyor belt of the dry clinker processing unit is set to be relatively low (e.g., approximately 5 mm/second), such that it can take about one hour, for such a conveyor belt, to carry the ashes thereon before this conveyor belt finally discharges the ashes into the clinker collecting means.

Thereafter, such additional combustion gas, produced by further burning the unburned biomass fuel having fallen down on the dry clinker processing unit, can be drawn upward into the furnace through the transition hopper from the bottom end of the furnace, and then confluent with the combustion gas having been produced in the furnace by burning the pulverized coal and biomass fuel together.

As described above, the present invention is intended to first allow the unburned biomass fuel, with the woody cores remaining therein, to fall down onto the dry clinker processing unit in a relatively great amount, and then supply the excessive or considerably great amount of combustion air to the dry clinker processing unit by the combustion-air supply unit, thereby positively burning the unburned biomass fuel having fallen down and then carried on the conveyor belt. In other words, the present invention is aimed at producing the heat of combustion to be taken into the furnace more effectively and efficiently by allowing the relatively great amount of biomass fuel, with the woody cores still remaining therein, to fall down onto the conveyor belt, and then positively burning such biomass fuel carried on the conveyor belt, which is used as a combustion plate located just below the transition hopper. This is the general feature of the method of the present invention for burning the biomass fuel together with the pulverized coal in the mixed state, thus being essentially different from the related art method intended for burning all of the fuel only in the furnace.

In order to adequately burn the woody or wood-based biomass fuel having fallen down on the conveyor belt, it is necessary to appropriately control the temperature, oxygen and time. In this case, since the temperature of the ashes, at the point of time that the ashes are falling down onto the furnace bottom, is equal to or higher than 1000° C., the temperature for further burning the unburned biomass fuel can be ensured enough. Besides, since the transfer velocity of the conveyor belt is set to be relative low, the time required for burning the unburned biomass fuel can also be ensured enough. Therefore, if the air can be supplied sufficiently for burning the so high temperature unburned biomass fuel on the conveyor belt, desired conditions for burning such biomass fuel can be adequately provided and continued.

Meanwhile, surplus oxygen that can be obtained when the sufficient amount of air is supplied for completely burning the biomass fuel carried on the conveyor belt will be drawn into the furnace and used for the combustion in the furnace. Desirably, upon the supply of the air to the biomass fuel carried on the conveyor belt, the air is ejected, efficiently, onto the biomass fuel on the conveyor belt. Namely, such efficient supply of the air can successfully control the surplus air or oxygen not to be used too much for the burning or combustion in the furnace.

As compared with the conventional method, the total amount of the fuel and the total amount of the air, respectively supplied to the biomass-mixed-firing pulverized coal fired boiler of this invention are not so changed. Namely, for the supply of the combustion air as described above, the present invention requires quite small-scale additional equipment.

In other words, the additional equipment to be required for embodying the method of the present invention for burning the biomass fuel together with the pulverized coal in the mixed state has to be quite small-scale. Besides, this invention can enable the use of a considerably small-sized biomass mill for milling the biomass fuel, thereby further saving the cost required for the operation and equipment of the boiler.

In addition, this invention can substantially mitigate the limitation on the milled particle size as well as on the ratio of the biomass fuel to be burned together with the pulverized coal in the mixed state.

However, as the ratio of the biomass fuel to be burned together with the pulverized coal in the mixed state is raised, and/or as the milled particle size is increased to be greater than 5 mm, the amount of the unburned biomass fuel that will fall onto the conveyor belt will increase so much. Therefore, such increase of the ratio of the biomass fuel and/or milled particle size should require a correspondingly great amount of the combustion air to be supplied to the dry clinker processing unit.

In this case, even though the amount of the air supplied to the dry clinker processing unit is considerably increased, the total amount of the air supplied to the boiler is not so changed. For instance, a 15 to 20% excessive amount of the air is supplied to the furnace upon the usual burning or combustion, while a 50 to 100% excessive amount of the air is required to be supplied for burning a considerably increased amount of the biomass fuel carried on the conveyor belt. However, some of the surplus air, after drawn into the furnace, will be flowed upward along or around an inner side wall of the furnace, and thus will not substantially contribute to the burning in the furnace. It is true that when the total amount of such excessive air is increased to some extent with the increase of the amount of the biomass fuel that will fall onto the conveyor belt, it can lead to a risk of somewhat deteriorating the combustion efficiency in the boiler. But, such deterioration of the combustion efficiency can be small in this invention.

Ideally, it should be preferable to completely burn in the furnace all of the biomass fuel supplied into the furnace. However, from the viewpoint of the combustion efficiency, the addition or introduction of the combustion heat energy into the boiler, which is achieved by further burning the coarse particles of the biomass fuel having fallen down on the conveyor belt of the dry clinker processing unit, can provide substantially the same effect as that obtained by such ideally complete burning of the fuel in the furnace. Besides, the boiler of this invention can employ such a small-sized biomass mill as described above, thus significantly reducing the cost required for the operation and equipment of the boiler.

The utilization of the biomass fuel in the pulverized coal fired boiler, for burning such biomass fuel together with the pulverized coal in the mixed state, has been demanded under the current economical, social and other like conditions and circumstances. In this case, the economical merit depends on the price of the biomass fuel to be used, the cost required for processing such fuel, the price of the coal fuel, and the like. Meanwhile, substantial reduction of consumption of the fossil fuel, secure reduction of the CO2 discharge, promotion of effective utilization of each local biomass material, and the like, can be mentioned as the social merit due to the utilization of the biomass fuel.

Namely, in view of such conditions and merits, the milled particle size of the biomass fuel to be actually used and/or ratio or proportion of such biomass fuel to be burned together with the pulverized coal in the mixed state should be appropriately selected.

Example 1

In this example, the biomass burner (or burners) is located above the pulverized coal burner (or burners).

This arrangement of the biomass burner is publicly known (see FIG. 6). Namely, this aspect including the biomass burner located above the pulverized coal burner can securely lengthen the period of time during which the biomass fuel can be subjected to the suspension firing in the furnace, thus reducing so much the unburned component (i.e., the carbonized material and/or woody material) that would otherwise fall down more onto the furnace bottom. Further, this arrangement can also contribute to substantial reduction of the amount of the combustion air to be supplied to the dry clinker processing unit. Accordingly, the aforementioned deterioration of the combustion efficiency in the biomass-mixed-firing pulverized coal fired boiler, associated with the increase of the amount of the combustion air, can be adequately controlled. Thus, according to this aspect, the ratio of the biomass fuel to be burned together with the pulverized coal in the mixed state can be significantly raised, while successfully controlling the deterioration of the combustion efficiency.

Example 2

In this example, the combustion-air supply unit is provided in the vicinity of the transition hopper, separately from the cooling-air supply unit.

Namely, such provision of the combustion-air supply unit can enable fresh air to be securely supplied to the unburned biomass fuel having fallen down on the conveyor belt, thereby well burning the biomass fuel, continuously, on the conveyor belt, thus significantly enhancing the burning effect. As such, the unburned component of the biomass fuel can be rapidly burned out when carried on the conveyor belt, with a relatively small amount of supplied air. Thus, this aspect can successfully prevent incomplete burning of such unburned component that may be otherwise accumulated together on the conveyor belt due to slow burning. Therefore, the unburned component can be securely burned out, and thus will never remain in a still unburned condition on the clinker processing unit.

Preferably, the aforementioned combustion-air supply unit is composed of air nozzles configured to eject the air at a high velocity toward a top face of the conveyor belt. This configuration can further enhance the efficiency of burning the unburned biomass fuel having fallen down on the conveyor belt.

Effects of the Invention

According to this invention, with the provision of the means (or step) for positively burning the unburned component of the biomass fuel contained in the ashes carried on the conveyor belt of the clinker processing unit provided around the furnace bottom, the heat of combustion generated by burning the unburned biomass fuel on the conveyor belt of the clinker processing unit can be effectively utilized in the boiler, even after such unburned biomass fuel has fallen down on the conveyor belt. Therefore, the power required for milling the biomass fuel can be significantly reduced, with the substantial increase of the ratio of the biomass fuel to be burned together with the pulverized coal in the mixed state by allowing the biomass fuel of the relatively large particle size, such as "the milled particle size equal to or greater than 5 mm," to be used, without requiring any large-scale equipment to be added to the basic construction of the conventional biomass-mixed-firing pulverized coal fired boiler.

Preferably, in this invention, the biomass fuel is milled by the exclusive biomass mill. This is because such milling of the biomass fuel will never cause any deterioration of the efficiency of milling the coal by the coal mill. Further, in this case, the milling of the biomass fuel into the particles of the milled particle size equal to or greater than 5 mm can significantly reduce the power required for milling the biomass fuel.

As described above, according to this invention, since the combustion air can be adequately supplied to the dry clinker processing unit, the considerably large amount of biomass fuel having fallen down on the conveyor belt can be positively burned and thus rapidly burned out on the dry clinker processing unit. Therefore, even such biomass fuel as having the milled particle size equal to or greater than 5 mm can be burned with a significantly high ratio of the biomass fuel to be burned together with the pulverized coal in the mixed state.

Further, even though slight degradation of the combustion efficiency in the boiler may be caused as described above, the biomass fuel can be burned substantially completely, even with a quite high ratio, such as 20% or so, of the biomass fuel to be burned together with the pulverized coal in the mixed state. Therefore, even in such a case, the unburned component (i.e., the carbonized material and/or woody material) of the biomass fuel will never remain in the ashes cooled around the furnace bottom.

BRIEF DESCRIPTION OF THE DRAWINGS

FIG. 8 is the graph showing one example of the distribution of the milled particle size estimated for each particle size of the milled biomass fuel.

FIG. 9 is the graph showing the relationship between the average milled particle size and the power unit.

BEST MODE FOR CARRYING OUT THE INVENTION

In one embodiment of the present invention, the biomass fuel of the 5 mm milled particle size supplied at 2.6 t/hour and the pulverized coal supplied at 10.8 t/hour are burned together in the mixed state in the biomass-mixed-firing pulverized coal fired boiler according to this embodiment, (in this case, the calorie burning ratio of the biomass fuel, i.e., the ratio of the biomass fuel to be burned together with the pulverized coal in the mixed state, is assumed as 10%). As a result, steam can be generated at 105 t/hour. Now, referring to FIG. 1, this biomass-mixed-firing pulverized coal fired boiler will be described.

In this embodiment, the woody (or wood-based) biomass fuel dried up to 20% water content is burned at 2.6 t/hour together with the pulverized coal in the mixed state in the boiler.

Figure 1:
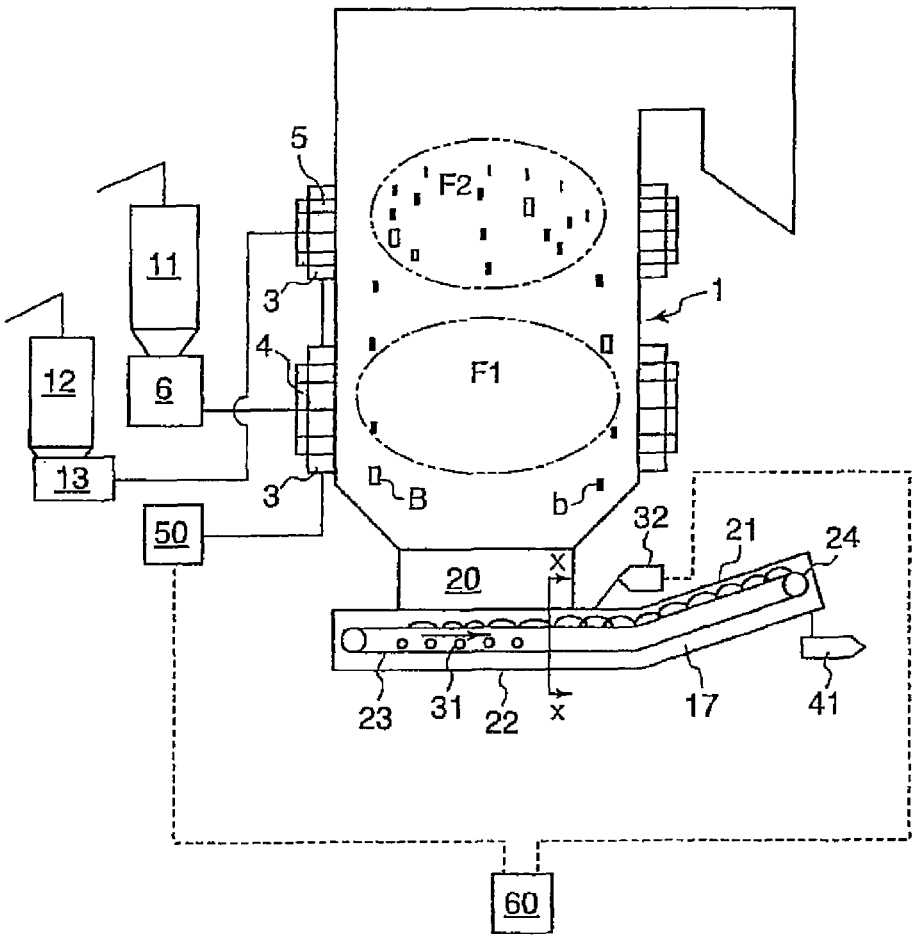
FIG. 1 is a section of the biomass-mixed-firing pulverized coal fired boiler according to one embodiment of the present invention.
Figure 7:
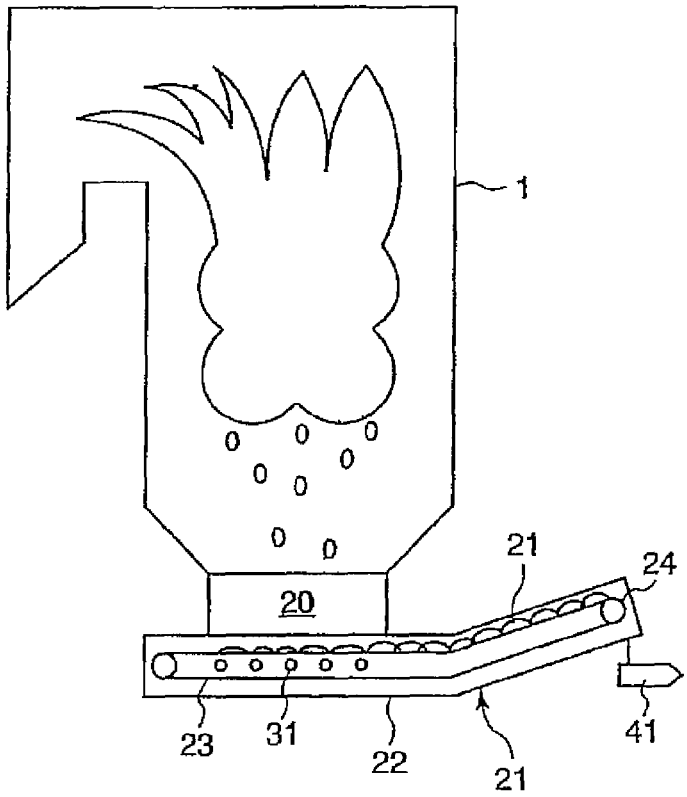
FIG. 7 is a section schematically illustrating the publicly known dry clinker processing unit.

In the biomass-mixed-firing pulverized coal fired boiler of this embodiment, as shown in FIG. 1, the pulverized coal burners 4 are respectively provided in the lower portion of the furnace 1, while the biomass burners 5 are respectively provided in the upper portion relative to the pulverized coal burners 4. Further, the dry clinker processing unit 21 is provided below the furnace 1 across the transition hopper 20. The structure of this dry clinker processing unit 21 is substantially the same as the structure of the publicly known dry clinker processing unit as shown in FIG. 7. Namely, the dry clinker processing unit 21 includes the conveyor belt 23 made of the highly heat-resistant metal and provided in the casing 22 of the unit 21. The conveyor belt 23 is configured for catching or receiving the ashes falling toward the furnace bottom, and designed to be moved from left to right in the drawing at approximately 5 mm/second. In addition, the conveyor belt 23 is driven by the drive wheels or rollers 24. Further, as is similar to the dry clinker processing unit shown in FIG. 7, several of cooling-air intake holes 31 are provided to one side face of the casing 22 of the dry clinker processing unit 21.

Each cooling-air intake hole 31 is usually opened to the outside air, while being configured to be optionally closed by a flap plate. With this configuration, when the pressure in the furnace is negative, the flap is opened to draw the outside air from each cooling-air intake hole 31, while when the pressure in the furnace is positive, the flap is closed to prevent the combustion gas produced in the furnace from being flowed out from each hole 31.

Further, in the biomass-mixed-firing pulverized coal fired boiler of this embodiment, the combustion-air supply unit 32, which is composed of an air supply source, piping and the like, is provided in the vicinity of the transition hopper 20. The flow rate of the combustion air supplied from the combustion-air supply unit 32 is controlled by a combustion-air controller 60.

In this case, the coal supplied from the coal bunker 11 is once milled by the coal mill 6, and then fed to the furnace 1 and burned in the lower combustion region F1 by each pulverized coal burner 4. Meanwhile, the biomass fuel is once supplied to the biomass bunker 12, and milled into the 5 mm milled particle size by the biomass mill 13, and then the so-milled particles of the biomass fuel are fed to the furnace 1 and burned in the upper combustion region F2 by each upper biomass burner 5. At this time, the particles of the biomass fuel are blown upward and suspended in the furnace 1 by the combustion gas produced in the lower combustion region F1. However, the medium particles and/or coarse particles among the so-suspended particles will be flowed downward around or along the inner side wall of the furnace 1, and then fall onto the conveyor belt 23 of the dry clinker processing unit 21 through the transition hopper 20.

Falling onto the conveyor belt 23, most of fine particles of the particle size less than 5 mm, among the particles of the biomass fuel, will be completely burned out into the ashes in the furnace 1, while being partly burned into a carbonized unburned material. Meanwhile, most of the medium particles b of the medium particle size a little greater than 5 mm and the coarse particles B of the particle size substantially exceeding 5 mm will fall down, as the carbonized unburned material or carbonized material with the woody cores remaining therein, onto the conveyor belt 23.

However, in this embodiment, when such medium particles b and coarse particles B fall down, as the carbonized unburned material or carbonized material with woody cores remaining therein, onto the conveyor belt 23, the combustion air, necessary for further burning such unburned and/or carbonized materials, can be supplied by the combustion-air supply unit 32. Therefore, the unburned components or materials of the medium particle size b and coarse particles B having respectively fallen down onto the conveyor belt 23 can be continuously burned, and thus completely burned in three minutes or so. Meanwhile, the ashes discharged from the bottom furnace and then carried on the conveyor belt 23 will be cooled enough by the cooling air supplied from the respective cooling-air intake holes 31 (this cooling air can be further flowed or supplied toward the interior of the furnace 1 through the transition hopper 20). Then, after being carried on the conveyor belt 23 for approximately one hour, the ashes will be discharged from the dry clinker processing unit 21 and collected into the clinker collecting device 41.

In the boiler of this embodiment adapted for generating the steam at 105 t/hour, the biomass fuel having the 5 mm milled particle size is burned together with the pulverized coal in the mixed state. Namely, in this biomass fuel, 90% by weight of the particles are the fine particles having the particle size equal to or less than 5 mm, while the remaining 10% by weight of the particles are the medium and coarse particles respectively having the particle size greater than 5 mm. Further, in this boiler, the calorie burning ratio of the biomass fuel, i.e., the ratio of the biomass fuel to be burned together with the pulverized coal in the mixed state, is 10%, the supply amount of the pulverized coal is 10.8 t/hour, and the supply amount the biomass fuel (of 20% water content) is 2.6 t/hour.

In this case, the amount of the biomass fuel of the particle size equal to or greater than 5 mm that can be considered to fall down onto the dry clinker processing unit 21 can be assumed as 0.26 t/hour, wherein approximately 70% of the unburned material can be expected as the woody material (or volatile component), while the remaining 30% of the unburned material can be considered as the carbonized material (or remaining coal component). However, most of the medium particles having the particle size of approximately 5 mm, among the 0.26 t biomass fuel, are likely to be burned out along the way of the falling. Thus, on the whole, an approximately half, i.e., 0.13 t/hour, of the biomass fuel of the particle size equal to or greater than 5 mm can be assumed to actually fall down onto the conveyor belt 23.

Figure 2:
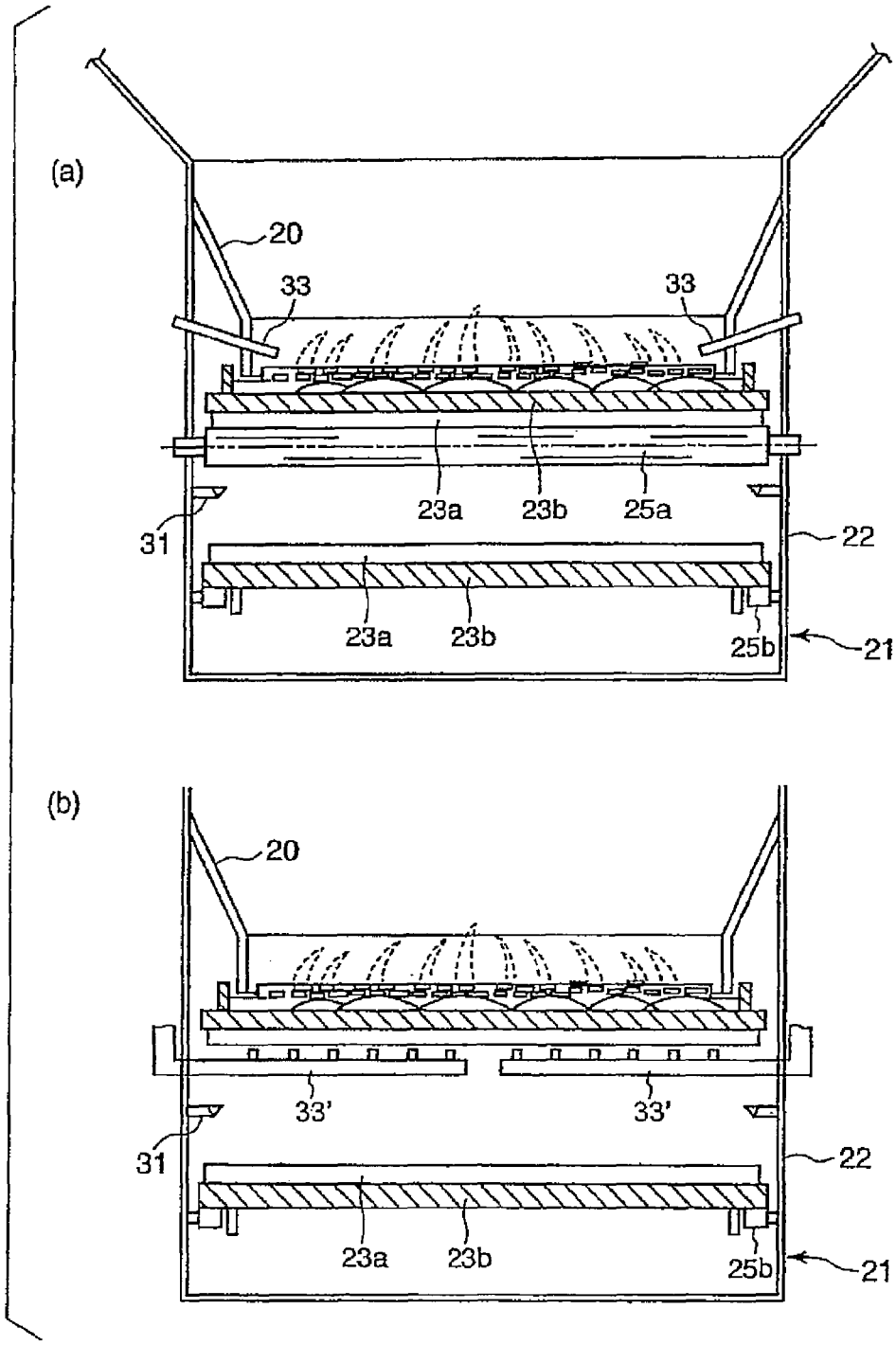
FIG. 2(*a*) is a section taken along line X-X in FIG. 1 and showing one arrangement of the combustion-air nozzles, and FIG. 2(*b*) is another section taken along line X-X in FIG. 1 and showing another arrangement of the combustion-air nozzles.

In the vicinity of the transition hopper 20, the air is supplied at 1,000 $Nm^3$ ($Nm^3$: the volume measured under 1 atom at 0° C.) per hour by the combustion-air supply unit 32. More specifically, as shown in FIG. 2(*a*), the combustion-air nozzles 33, which constitute together a part of the combustion-air supply unit 32, are respectively provided on both left and right sides at a bottom end of the transition hopper 20. Thus, the air can be ejected from such combustion-air nozzles 33, at approximately 30 m/second, obliquely to the top face of the conveyor belt 23 moved just below the transition hopper 20.

As such, the combustion air can be directly ejected onto the biomass fuel having fallen down on the conveyor belt 23. In this manner, such unburned biomass fuel having fallen down on the conveyor belt 23 moved at approximately 5 mm/second will be burned out into the ashes in three minutes or so.

In FIG. 2(*a*), the combustion-air nozzles 33 are respectively arranged, such that the combustion air can be ejected obliquely to the front face of the conveyor belt 23 from both of the left and right combustion-air nozzles 33. However, as shown in FIG. 2(*b*), the combustion-air nozzles 33' may also be arranged, such that the combustion air can be ejected toward the rear face of the conveyor belt 23.

In addition, the air can be supplied to a space under the conveyor belt at 2,000 $Nm^3$/hour by the cooling-air intake holes 31.

The total amount of the air supplied for the combustion or burning in the furnace of the boiler of this embodiment is 100,000 $Nm^3$/hour. In this case, as described above, the amount of the air supplied to the dry clinker processing unit by the combustion-air supply unit 32 is 1,000 $Nm^3$/hour, while the amount of the air supplied to the clinker processing unit by the cooling-air intake holes 31 is 2,000 $m^3$/hour. Namely, from such air supply unit 31, 32, the total of 3,000 $Nm^3$ air can be drawn per hour into the furnace 1, upon the combustion or burning, through the transition hopper 20. Accordingly, the remaining 97,000 $Nm^3$ combustion air can be supplied to the furnace 1 from a combustion-air supply unit 50 (see FIG. 1) through the wind box 3.

The flow rate of the combustion air supplied from the combustion-air supply unit 50 is controlled by the combustion-air controller 60. As described above, the flow rate of the combustion air supplied from the combustion-air supply unit 32 is also controlled by the combustion-air controller 60. Namely, this combustion-air controller 60 can serve to control each flow rate of the combustion air supplied from the combustion-air supply unit 50 as well as supplied from the combustion-air supply unit 32. Under such control, the amount of the combustion air supplied over the entire body of the boiler can be optimized.

Figure 3:
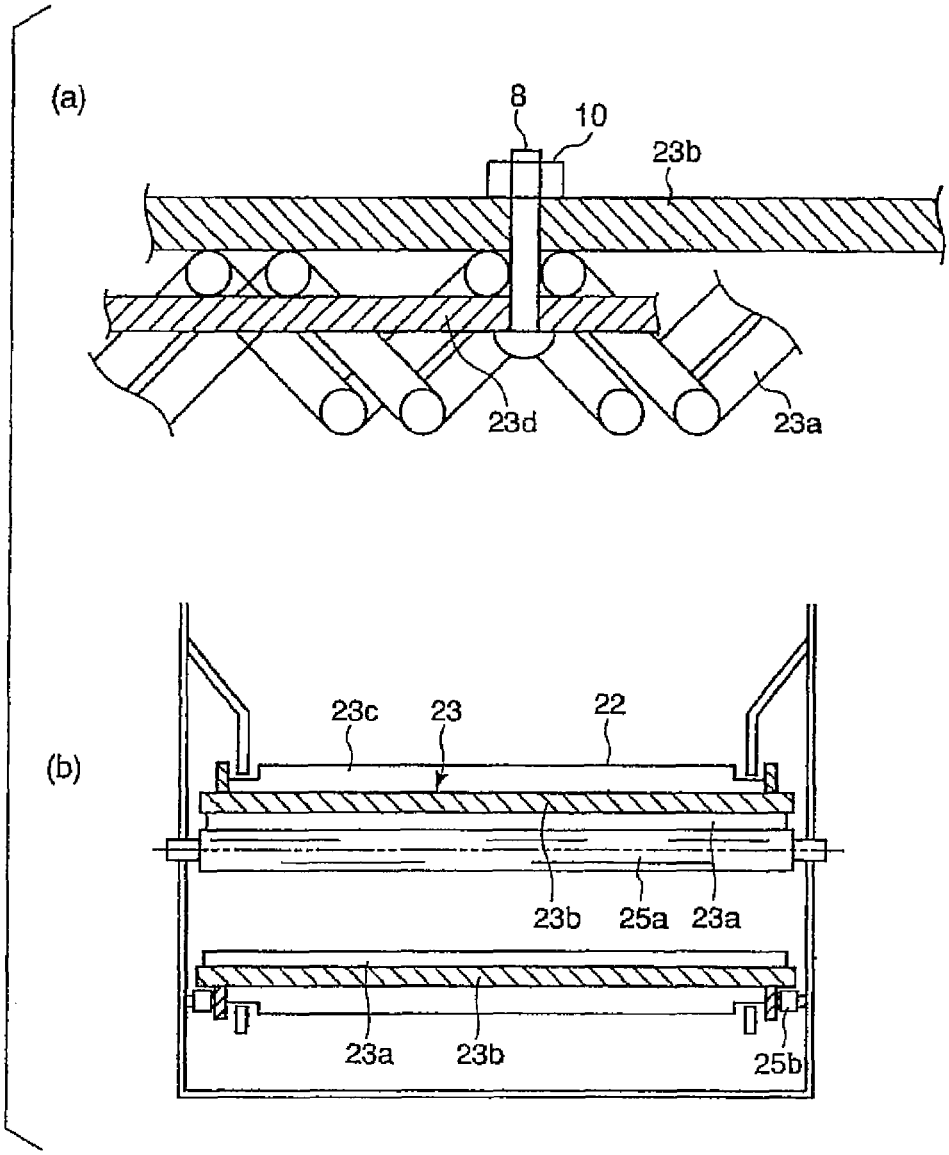
FIG. 3(*a*) is a section of a part of the conveyor belt of the dry clinker processing unit in the biomass-mixed-firing pulverized coal fired boiler according to the embodiment of the present invention, and FIG. 3(*b*) is another section illustrating the conveyor belt.
Figure 4:
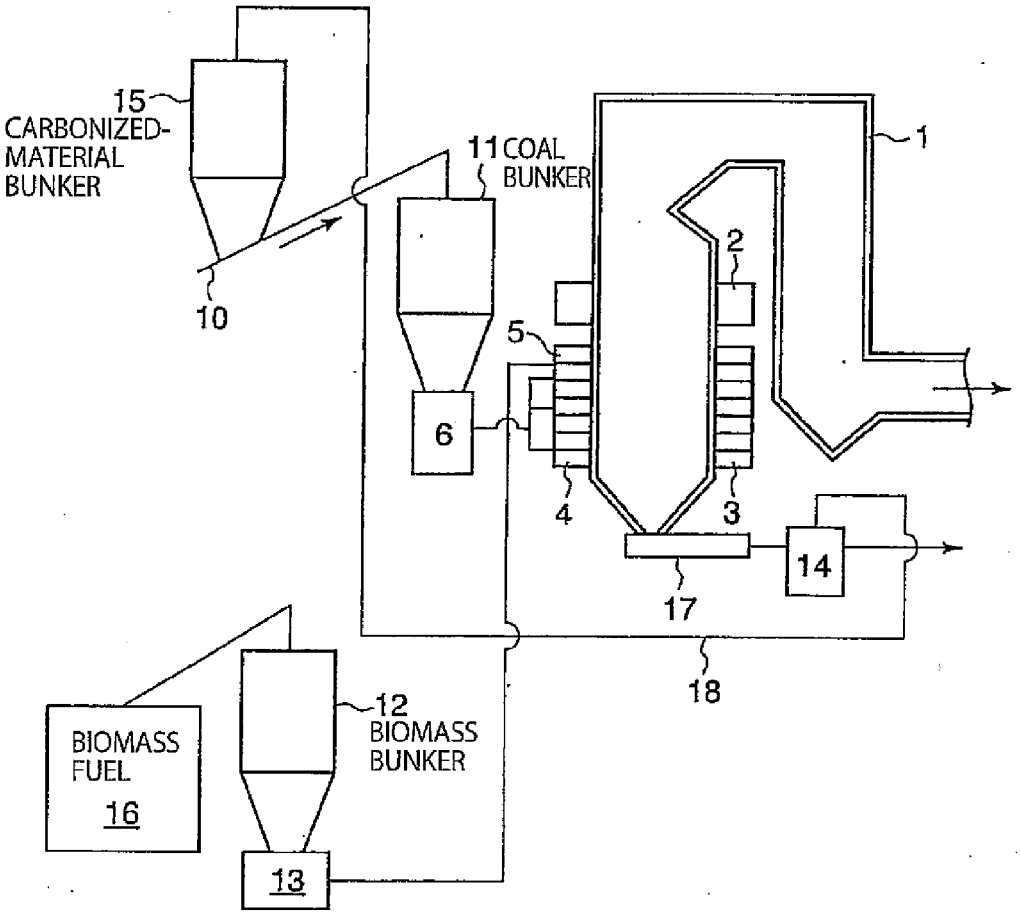
FIG. 4 is a section showing one example of the related art biomass-mixed-firing pulverized coal fired boiler.
Figure 5:
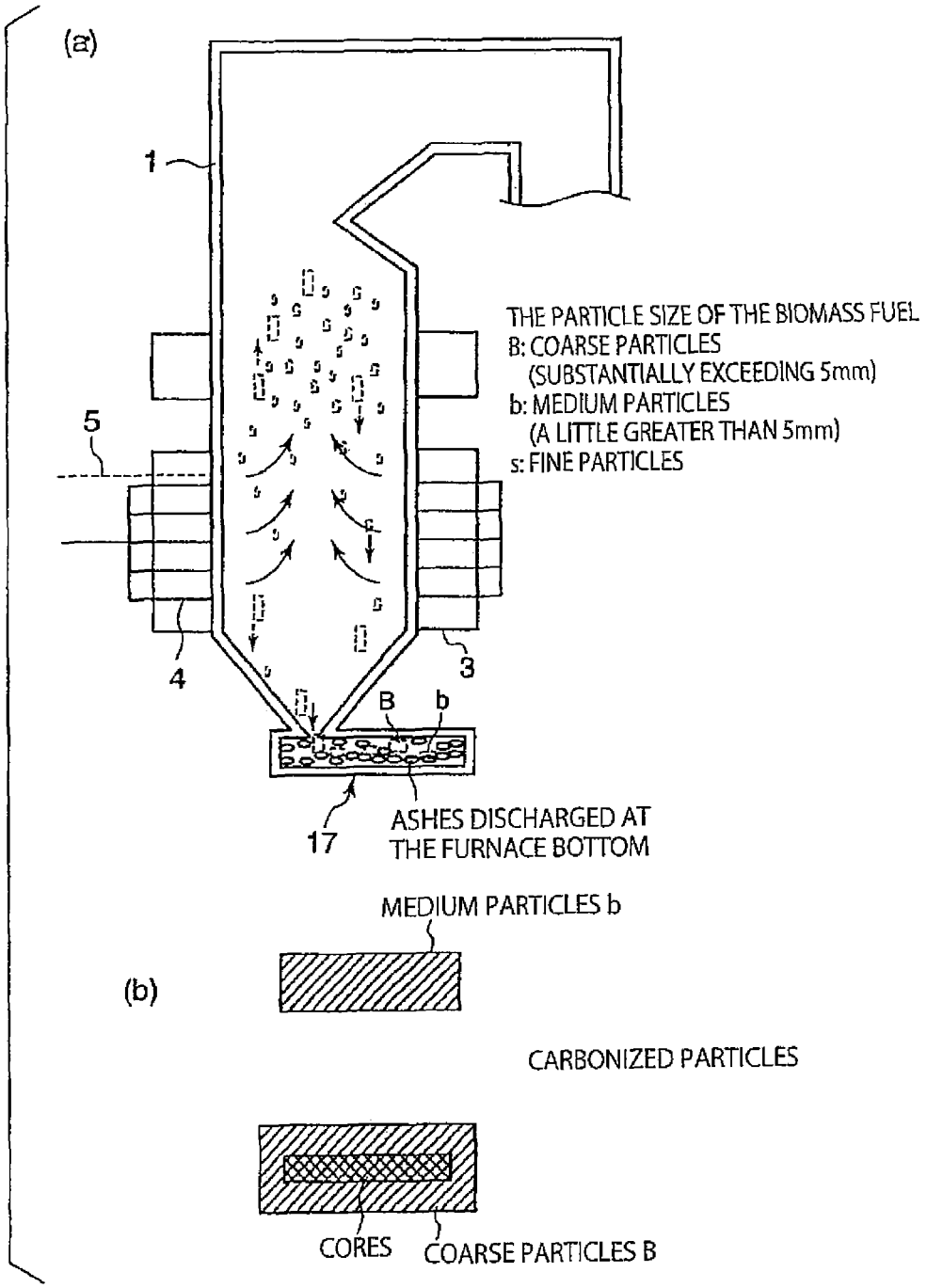
FIG. 5(*a*) is a diagram illustrating a burned condition of the biomass fuel in the related art boiler shown in FIG. 4, and FIG. 5(*b*) is a section schematically showing unburned biomass fuel.
Figure 6:
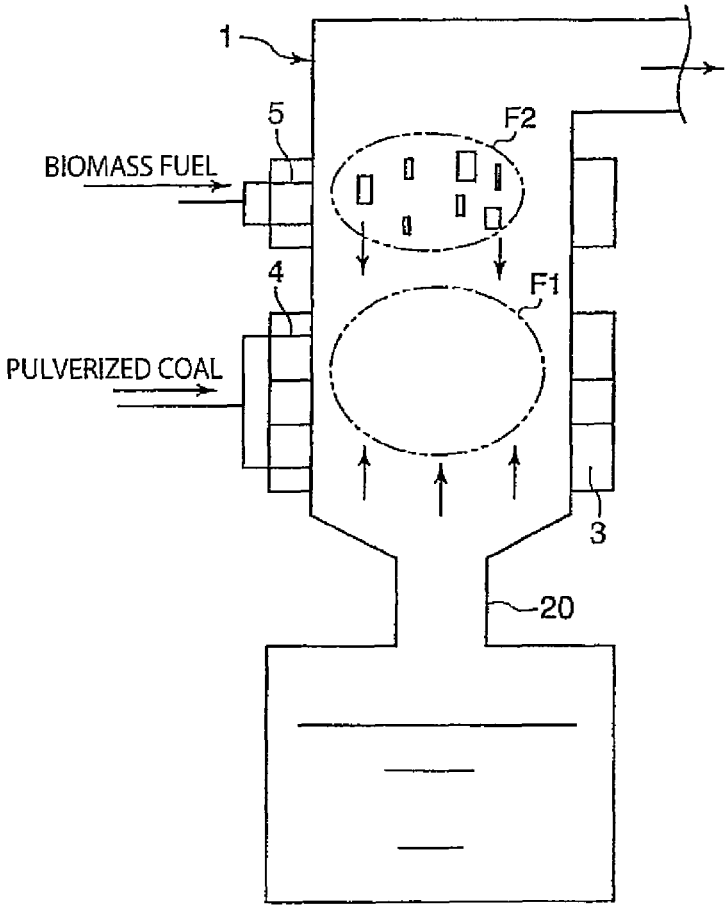
FIG. 6 is a section showing one arrangement of the pulverized coal burners and biomass burners in another example of the related art.

The general structure of the dry clinker processing unit 21 used in this embodiment is substantially the same as the structure of the known dry clinker processing unit as described in the above JP7-56375A (Patent Document 4). Namely, as shown in the section of FIG. 3(*a*), the conveyor belt 23 is composed of a net-like or mesh-like belt 23*a* formed of metal wires and several of steel plates 23*b*. Further, as shown in FIG. 3(*b*), this conveyor belt 23 is supported by the casing or main body 22, via a plurality of guide rollers 25*a*, 25*b*.

Further, as shown in FIG. 3(*a*), each wire constituting the mesh-like belt 23*a* is fixed in position by a bolt 8 and a nut 10, while being grasped or held between a ledge 23*d* and each corresponding steel plate 23*b*. In this case, the several steel plates 23*b* are combined together, while being partly overlapped one on another in order to cover the entire mesh-like belt 23*a*.

While several preferred examples of this invention have been shown and described, specifically to some extent, it should be obviously understood that various modifications and alterations can be made thereto. Accordingly, it should be construed that this invention can be embodied in different manners and/or aspects from those specifically described and shown herein, without departing from the gist and scope of this invention.

The invention claimed is:

1. A biomass-mixed-firing pulverized coal fired boiler, comprising:

a furnace configured to burn a biomass fuel together with a pulverized coal in a mixed state;

a pulverized coal burner configured to supply the pulverized coal into the furnace;

a biomass burner configured to supply the biomass fuel into the furnace;

a biomass mill configured to mill the biomass fuel to be supplied to the biomass burner;

a dry clinker processing unit provided below the furnace, the dry clinker processing unit including a clinker conveyor configured to carry ashes discharged from the furnace at a furnace bottom;

a combustion-air supply unit configured to supply a combustion air toward the ashes on the clinker conveyor through combustion air nozzles provided at a bottom end of a transition hopper located between the furnace and the clinker conveyor so as to burn an unburned component of the biomass fuel contained in the ashes discharged at the furnace bottom on the clinker conveyor;

a cooling-air supply unit configured to supply a cooling air to the dry clinker processing unit through cooling air intakes provided on one side face of a casing of the dry clinker processing unit, distinct from the combustion air nozzles; and a combustion-air controller configured to optimize an efficiency of combustion in an entire boiler by controlling both of a flow rate of a combustion air supplied toward an interior of the furnace and a flow rate of the combustion air supplied from the combustion-air supply unit toward the ashes discharged at the furnace bottom on the clinker conveyor, so that the amount of combustion air supplied over the entire boiler is optimized, wherein the combustion air nozzles are located at the transition hopper and are configured to impact air onto the ashes on the clinker conveyor thereby increasing burning of the unburned component of the biomass fuel contained in the ashes.

2. The biomass-mixed-firing pulverized coal fired boiler according to claim 1, wherein the biomass mill is configured to mill the biomass fuel into particles having a milled particle size equal to or greater than 5 mm.

3. The biomass-mixed-firing pulverized coal fired boiler according to claim 1, wherein the biomass burner is located above the pulverized coal burner.

4. The biomass-mixed-firing pulverized coal fired boiler according to claim 1, further comprising a coal mill configured to mill a coal so as to produce the pulverized coal to be supplied to the pulverized coal burner.

5. The biomass-mixed-firing pulverized coal fired boiler according to claim 4, wherein the biomass mill is exclusively used for milling the biomass fuel, and the coal mill is exclusively used for milling the coal.

6. A method of operating a biomass-mixed-firing pulverized coal fired boiler, comprising the steps of:

milling a biomass fuel by using a biomass mill;

supplying a milled biomass fuel to a furnace by using a biomass burner;

supplying a pulverized coal to the furnace by using a pulverized coal burner;

burning an unburned component of the biomass fuel contained in ashes discharged at a furnace bottom on a conveyor belt of a dry clinker processing unit, which is provided below the furnace, by supplying a combustion air toward the ashes on the clinker conveyor through combustion air nozzles provided at a bottom end of a transition hopper located between the furnace and the clinker conveyor;

supplying cooling air to the dry clinker processing unit through cooling air provided on one side face of a casing of the dry clinker processing unit and distinct from the combustion air nozzles, wherein an efficiency of combustion in an entire boiler is optimized by controlling both of a flow rate of a combustion air supplied toward an interior of the furnace and a flow rate of the combustion air supplied toward the ashes discharged at the furnace bottom on the clinker conveyor, so that the amount of combustion air supplied over the entire boiler is optimized, wherein the combustion air nozzles are located at the transition hopper and are configured to impact air onto the ashes on the clinker conveyor thereby increasing burning of the unburned component of the biomass fuel contained in the ashes.

7. The method of operating the boiler according to claim 6, wherein the biomass fuel is milled by using the biomass mill into particles having a milled particle size equal to or greater than 5 mm.

8. The method of operating the boiler according to claim 6, wherein the biomass fuel is supplied to the furnace from the biomass burner which is located above the pulverized coal burner.

9. The method of operating the boiler according to claim 6, further comprising a step of milling a coal by using a coal mill so as to produce the pulverized coal to be supplied to the pulverized coal burner.

10. The method of operating the boiler according to claim 9, wherein the biomass mill is exclusively used for milling the biomass fuel, and the coal mill is exclusively used for milling the coal.

11. A biomass-mixed-firing pulverized coal fired boiler, comprising:

a furnace configured to burn a biomass fuel together with a pulverized coal in a mixed state;

a pulverized coal burner configured to supply the pulverized coal into the furnace;

a biomass burner configured to supply the biomass fuel into the furnace;

a biomass mill configured to mill the biomass fuel to be supplied to the biomass burner;

a dry clinker processing unit provided below the furnace, the dry clinker processing unit including a clinker conveyor configured to carry ashes discharged from the furnace at a furnace bottom;

a combustion-air supply unit configured to supply a combustion air toward the ashes on the clinker conveyor through combustion air nozzles arranged such that the combustion air is ejected toward the rear face of the conveyor belt as to burn an unburned component of the biomass fuel contained in the ashes discharged at the furnace bottom on the clinker conveyor;

a cooling-air supply unit configured to supply a cooling air to the dry clinker processing unit through cooling air intakes, distinct from the combustion air nozzles; and a combustion-air controller configured to optimize an efficiency of combustion in an entire boiler by controlling both of a flow rate of a combustion air supplied toward an interior of the furnace and a flow rate of the combustion air supplied from the combustion-air supply unit toward the ashes discharged at the furnace bottom on the clinker conveyor, so that the amount of combustion air supplied over the entire boiler is optimized, wherein the combustion air nozzles are located at the transition hopper and are configured to impact air onto the ashes on the clinker conveyor thereby increasing burning of the unburned component of the biomass fuel contained in the ashes.

* * * * *